US010119275B2

(12) United States Patent
Günther

(10) Patent No.: US 10,119,275 B2
(45) Date of Patent: Nov. 6, 2018

(54) FLAT COMPONENT, SHEAR FORCE REINFORCING ELEMENT, AND REINFORCED CONCRETE/PRESTRESSED CONCRETE COMPONENT WITH A SHEAR FORCE REINFORCEMENT OF SUCH SHEAR FORCE REINFORCING ELEMENTS

(71) Applicant: Technische Hochschule Mittelhessen, Gießen (DE)

(72) Inventor: Gerd Günther, Bad Orb (DE)

(73) Assignee: Technische Hochschule Mittelhessen, Gießen (DE)

( * ) Notice: Subject to any disclaimer, the term of this patent is extended or adjusted under 35 U.S.C. 154(b) by 0 days.

(21) Appl. No.: 15/307,829

(22) PCT Filed: Apr. 29, 2015

(86) PCT No.: PCT/EP2015/059366
§ 371 (c)(1),
(2) Date: Mar. 20, 2017

(87) PCT Pub. No.: WO2015/165982
PCT Pub. Date: Nov. 5, 2015

(65) Prior Publication Data

US 2017/0204606 A1 Jul. 20, 2017

(30) Foreign Application Priority Data

Apr. 30, 2014 (EP) ..... 14166745

(51) Int. Cl.
*E04C 5/06* (2006.01)
*E04C 5/16* (2006.01)
(Continued)

(52) U.S. Cl.
CPC ..... *E04C 5/06* (2013.01); *E04B 5/32* (2013.01); *E04C 5/0645* (2013.01); *E04C 5/08* (2013.01); *E04C 5/163* (2013.01); *E04C 5/166* (2013.01)

(58) Field of Classification Search
CPC ... E04C 2/06; E04C 5/16; E04C 5/168; E04C 5/07; E04C 5/08; E04C 2/044; E04C 5/00;
(Continued)

(56) References Cited

U.S. PATENT DOCUMENTS 1,063,663 A * 6/1913 Davis ..... E04C 5/168 52/686
1,492,441 A * 4/1924 Foster ..... E04C 5/18 52/649.4
(Continued)

FOREIGN PATENT DOCUMENTS

DE 10 2009 056826 A1 2/2001
WO 2004/081313 A1 9/2004
(Continued)

OTHER PUBLICATIONS

European Patent Office, International Search Report for Application No. PCT/EP2015/059366, dated Jun. 5, 2015.
(Continued)

*Primary Examiner* — Robert Canfield
*Assistant Examiner* — Matthew J Gitlin
(74) *Attorney, Agent, or Firm* — SoCal IP Law Group LLP; Guy L. Cumberbatch

(57) ABSTRACT

The invention relates to L-shaped sheet metal parts 21 with an angled longitudinal recess 23 as well as a reinforced concrete/prestressed concrete component with at least one upper and at least one lower longitudinal reinforcement layer and a shear force reinforcement guided in its dimen-
(Continued)

Figure 1:
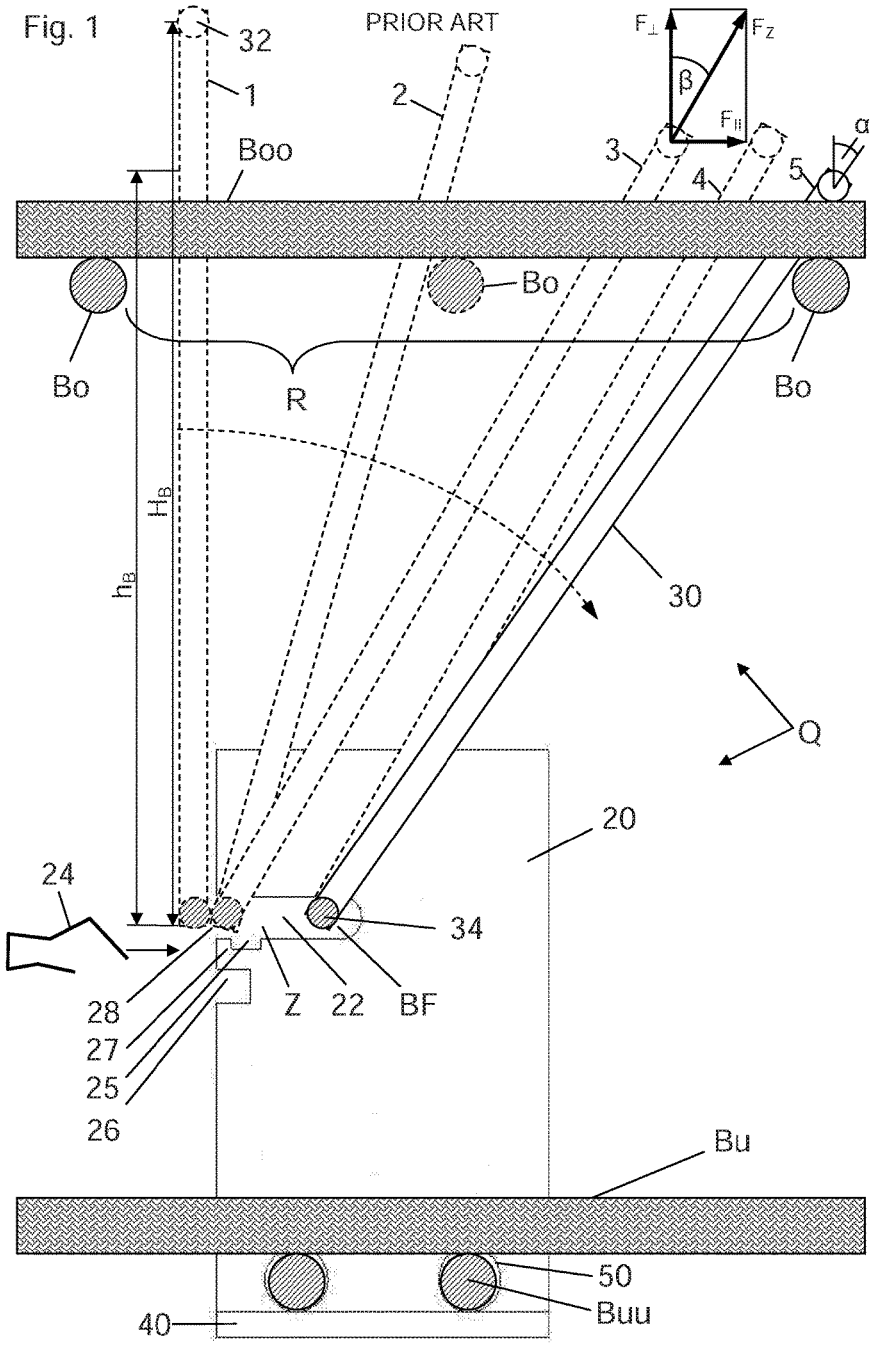
Fig. 1 PRIOR ART

sion over the uppermost and the lowermost longitudinal reinforcement, which is formed from the L-shaped sheet metal parts 21 according to the invention with stirrups 30 fastened in the longitudinal recess 23. The reinforced concrete/prestressed concrete component according to the invention is suitable for increasing the punching shear resistance in the region of slab columns of flat slabs.

19 Claims, 6 Drawing Sheets

(51) Int. Cl.
*E04B 5/32* (2006.01)
*E04C 5/08* (2006.01)

(58) Field of Classification Search
CPC ..... E04C 5/0645; E04C 5/06; E04C 5/163; E04C 5/166; E04B 5/32; E04B 2001/2484; E04B 2103/02; E04B 1/16; E04B 1/165; E04B 1/167; E04B 1/24; E04B 5/023; E04B 1/34315; E04B 1/61; E04B 2001/2415; E04B 2001/2448
USPC ..... 52/677, 687, 689, 742.14, 649.1, 649.6, 52/649.8, 649.7, 650.1, 650.2, 654.1, 52/745.05, 223.14; 264/35.279, 279.1; 248/267; 428/577
See application file for complete search history.

(56) References Cited

U.S. PATENT DOCUMENTS 1,613,351 A * 1/1927 Klinger ..... E04C 5/168 404/135
1,867,974 A * 7/1932 Keough ..... E06B 9/50 248/267
2,392,337 A * 1/1946 Perry ..... E06B 9/50 248/267
2,500,706 A * 3/1950 Roshko ..... E06B 9/50 248/267
2,525,513 A * 10/1950 Barr ..... E06B 9/50 248/267
2,886,370 A * 5/1959 Liebert ..... B28B 23/005 294/82.1
2,911,819 A * 11/1959 Austin ..... E04C 5/18 52/684
3,114,221 A * 12/1963 Eriksson ..... E04C 5/18 404/136
3,238,684 A * 3/1966 Wood ..... E04B 2/8635 52/379
4,368,506 A * 1/1983 Rapp ..... F21V 21/03 362/147
4,496,264 A * 1/1985 Casey ..... E01F 15/086 256/13.1
4,644,727 A * 2/1987 Hanson ..... E04C 5/08 52/678
4,702,045 A * 10/1987 Fricker ..... E04G 21/142 52/125.4
4,835,933 A * 6/1989 Yung ..... E04C 5/168 248/74.4
4,854,106 A * 8/1989 Bogar ..... E04C 5/162 52/686
5,596,846 A * 1/1997 Kelly ..... E04G 21/142 52/125.2
6,024,333 A * 2/2000 Raasch ..... A47B 55/02 211/134
6,212,848 B1 * 4/2001 Cooper ..... E04C 5/168 404/135
D520,649 S * 5/2006 Hansort ..... D25/133
7,111,432 B2 * 9/2006 Hansort ..... E04G 21/142 52/125.4
7,140,307 B1 * 11/2006 Wolbert ..... A47B 47/0075 108/153.1
7,963,392 B2 * 6/2011 Kodi ..... E04C 5/167 206/340
8,235,350 B2 * 8/2012 Tetsuda ..... F16F 1/3732 248/560
8,322,109 B2 * 12/2012 Trangsrud ..... E04C 5/162 52/685
8,650,828 B2 * 2/2014 Gunther ..... E04C 5/0645 52/649.8
8,707,644 B2 * 4/2014 Degen ..... E04B 1/6116 52/309.12
8,815,366 B2 * 8/2014 Gunther ..... E04C 5/0645 428/105
8,925,893 B2 * 1/2015 Biedenweg ..... B60P 7/0807 248/500
2007/0101672 A1 * 5/2007 Gunther ..... E04C 5/0645 52/698
2008/0209843 A1 * 9/2008 Helms ..... E04C 5/163 52/677
2009/0189036 A1 * 7/2009 Foster ..... E04B 1/82 248/220.1
2009/0217612 A1 * 9/2009 Window ..... E04C 2/384 52/414

FOREIGN PATENT DOCUMENTS

WO 2005/035900 A1 4/2005
WO 2015/165982 A1 11/2015

OTHER PUBLICATIONS

International Searching Authority, Written Opinion of the International Searching Authority for Application No. PCT/EP2015/059366, dated Nov. 5, 2015.

* cited by examiner 32
1
2
Boo
3
4
5
α
β
F⊥
Fz
F∥
Bo
Bo
Bo
R
HB
hB
30
Q
20
24
34
28
27
25
26
Z
22
BF
Bu
50
Buu
40

Figure 2A:
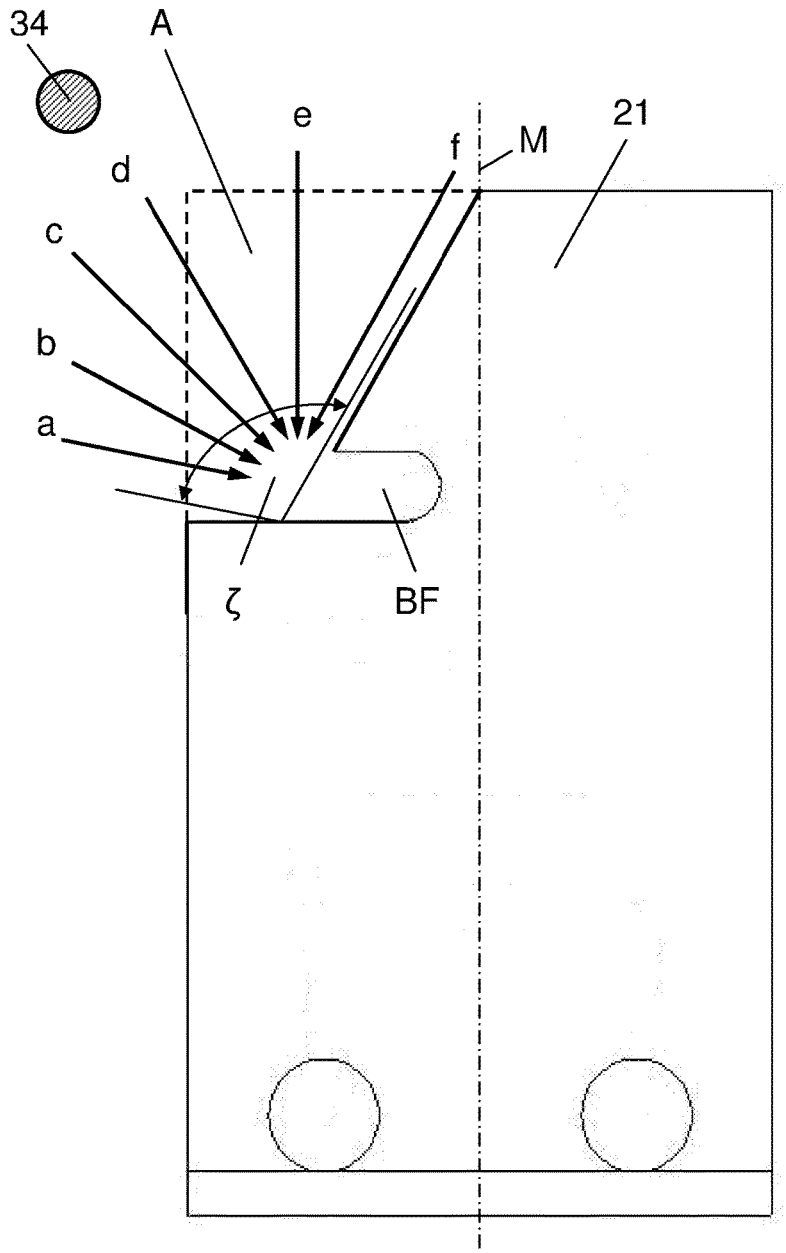
Figure 2B:
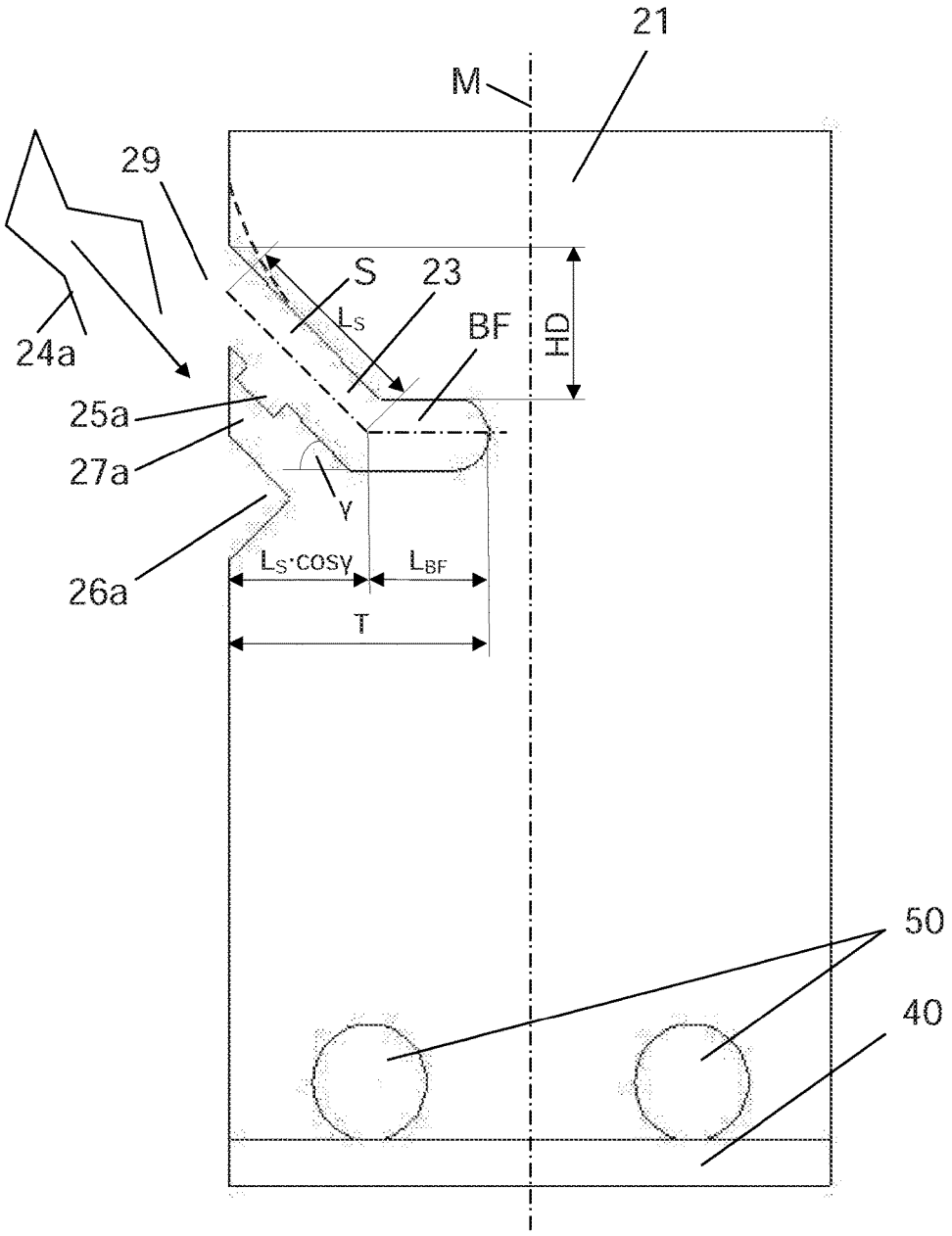
Figure 3:
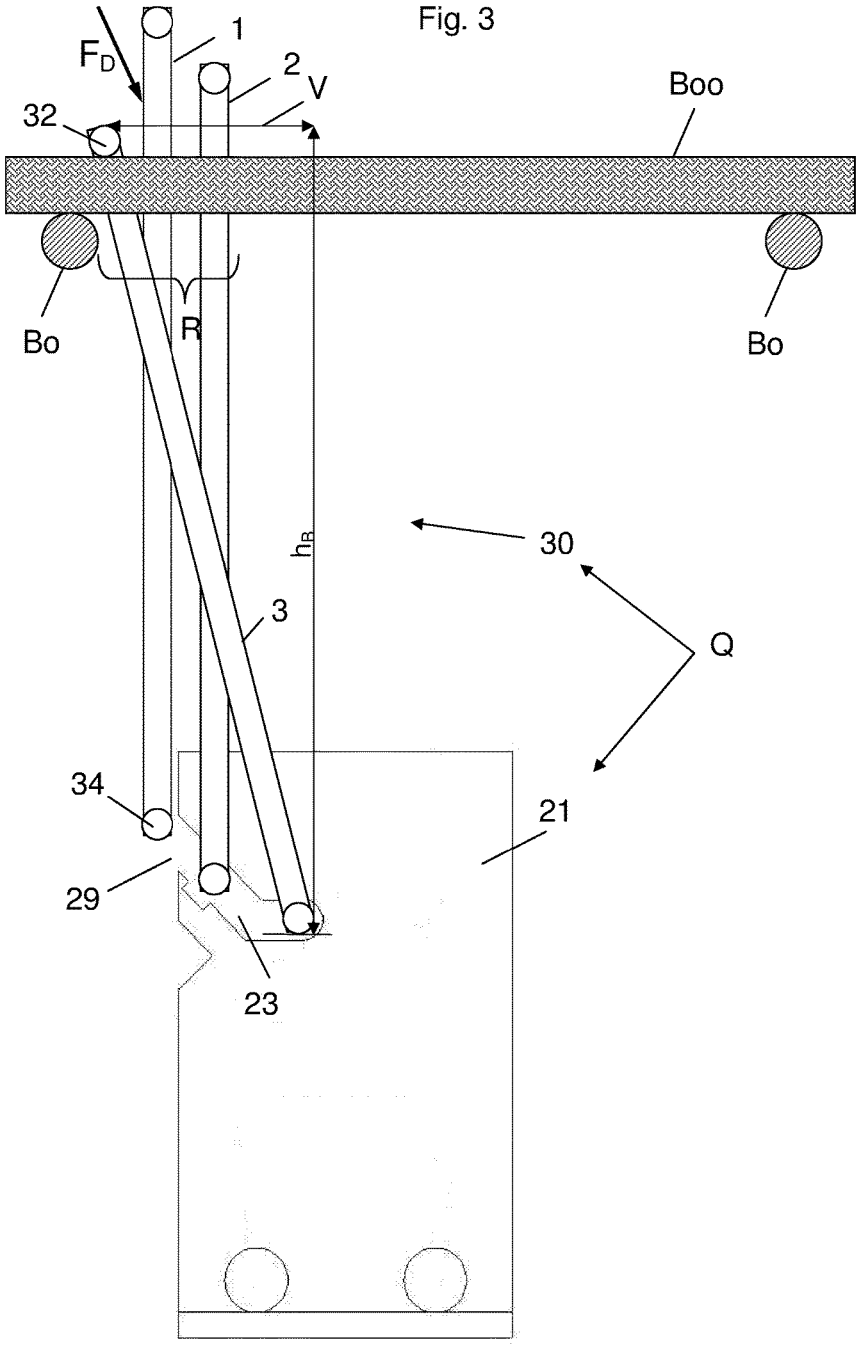

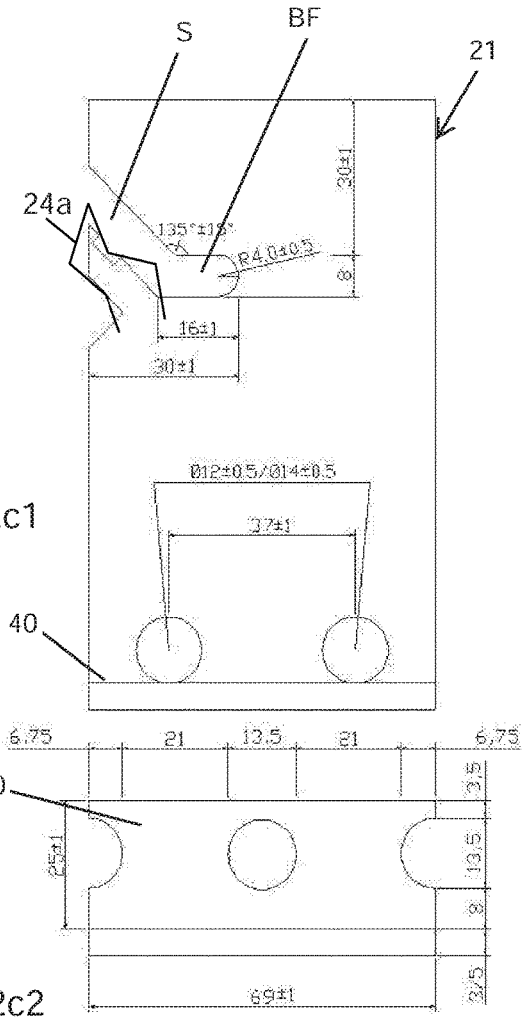
Fig. 2c1
Fig. 2c2
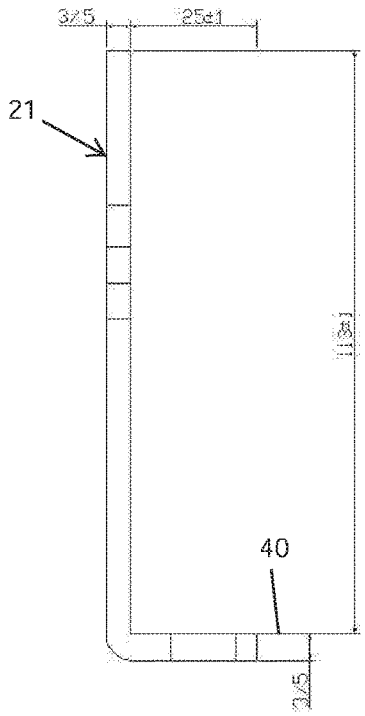
Fig. 2c3

FLAT COMPONENT, SHEAR FORCE REINFORCING ELEMENT, AND REINFORCED CONCRETE/PRESTRESSED CONCRETE COMPONENT WITH A SHEAR FORCE REINFORCEMENT OF SUCH SHEAR FORCE REINFORCING ELEMENTS

FIELD OF THE INVENTION

The invention relates to the field of reinforced concrete and prestressed concrete structures, in particular the shear force reinforcement of reinforced concrete/prestressed concrete elements.

PRIOR ART

In reinforced concrete/prestressed concrete elements, a reliable shear force reinforcement is necessary in the region of bearing points, in particular in the region of column connections, for absorbing the shear forces occurring there due to the column forces.

DE102009056826A1 describes a reinforced concrete/prestressed concrete component with at least one upper and at least one lower longitudinal reinforcement layer and a shear force reinforcement which can absorb large shear forces and lateral forces and can be produced inexpensively as an in-situ concrete part and also as a semi-precast part. These advantageous properties are achieved by the shear force reinforcement consisting of at least 20 L-shaped sheet metal parts 20 made of structural steel, each with one or two stirrups 30, which are arranged with their stirrup arch 34 in a straight longitudinal recess 22 of the associated sheet metal part 30, whereby the shear force reinforcement is guided in its dimension over the uppermost longitudinal reinforcement layer Boo and the lowermost longitudinal reinforcement layer Buu. The horizontal longitudinal recess 22 has a feed region Z with an opening 28 suitable for the insertion of a stirrup arch 34 on a side edge of the L-shaped sheet metal part 20. Furthermore, the straight longitudinal recess 22 has a fastening region BF, in which the arches 34 are fixed by one or two stirrups 30. Both, the feed region Z and the fastening region BF, run horizontally and merge smoothly into one another.

FIG. 1 (prior art) shows a schematic representation of such a known shear force reinforcing element Q consisting of an L-shaped sheet metal part 20 and a stirrup 30. The shear force reinforcing element Q is shown in the installed state in which it is connected to the lower and the upper longitudinal reinforcement of a reinforced concrete/prestressed concrete component. In this case, the L-shaped sheet metal part 20 is connected to the lower longitudinal reinforcement, consisting of the longitudinal reinforcement layers Bu, Buu, while the stirrup 30 installed in the horizontal longitudinal recess 22 ensures the connection to the upper longitudinal reinforcement consisting of the longitudinal reinforcement layers Bo, Boo. For this purpose, it rests with its stirrup shoulders 32, which protrude forwards and backwards from the drawing plane, on two bars of the uppermost longitudinal reinforcement layer Boo while the stirrup arch 34 is positioned in the fastening region BF of the horizontal longitudinal recess 22. The positioning of the stirrup arch 34 is only possible by the latter being introduced through the opening 28 into the feed region Z and, following its horizontal course, guided into the fastening region BF. The stirrup arch 34 can be moved here only horizontally. A clip plate part 24 is provided for securing the stirrup 30 in the fastening region BF of the horizontal longitudinal recess 22. The clip plate part 24 is slid in the direction of the arrow on a notched projection 27 formed by two rectangular recesses 25, 26 and snapped in.

The L-shaped sheet metal part 20 is connected to the lower longitudinal reinforcement by the L-shaped sheet metal part 20 being provided with a bend (which forms the L-shape) protruding forwards from the drawing plane and grasping the lowest longitudinal reinforcement layer Buu. In addition, two circular recesses 50 are arranged immediately above the bend 40, through which two bars of the lowest reinforcement layer Buu are guided. These two measures ensure a secure connection between the L-shaped sheet metal part 20 and the lowest longitudinal reinforcement layer Buu. The stirrup 30 resting with its shoulders on two bars of the uppermost longitudinal reinforcement layer Boo assumes an inclination angle $\alpha$ which can be up to 45° with respect to the vertical. In this case, the stirrup length $H_B$ is given by $H_B = h_B/\cos\alpha$, where $h_B$ is the minimum stirrup length which a vertically oriented stirrup 30 resting with its stirrup shoulders 32 on the bars of the uppermost longitudinal reinforcement layer Boo would have.

Disadvantages of the Prior Art

Practical tests have shown that the positioning of one or two stirrups 30 in the straight longitudinal recess 22 of an L-shaped sheet metal part 20 according to the prior art is possible only by manually pulling-in the stirrup 30 into the straight longitudinal recess 22, which is designed as a horizontal long hole. The following disadvantages related to pulling-in were identified:

It is necessary to use long stirrups 30 whose stirrup length $H_B$ is greater than the minimum stirrup length $h_B$ by a factor which can be up to $\sqrt{2}$. The material consumption for such stirrups is unnecessarily high.

In the installed state, the stirrups are very slanting at an inclination angle $\alpha$ against the vertical, which is up to 45°. The stirrup can therefore be installed swivelled up to 90°. Thus, there is the risk of bringing the stirrup 30 into an end position in which it is strongly deflected out of its optimum position, in which it absorbs tensile stresses in the finished reinforced concrete/prestressed concrete element (i.e., it is set under compressive stress and thus is non-functional).

The force to be applied by an operator when manually pulling in the stirrup 30 is high.

In the case of unfavorable geometrical conditions, in particular in the event of a collision with one or more bars of the upper longitudinal reinforcement layer Bo, the insertion of a stirrup 30 is only possible if, by temporarily removing this bar/these bars, a sufficiently large clearance R for pulling-in the stirrup is created. Therefore it is not possible to design the upper longitudinal reinforcement Bo, Boo in the form of reinforcement mats.

Reinforcement mats are prefabricated components, in which the bars of the two longitudinal reinforcement layers Boo and Bo are welded to a grid, i.e. are already fixed. Compared to single reinforcing bars, they can be installed much faster and more precisely. Their use is an essential prerequisite for the efficient production of reinforced concrete/prestressed concrete elements. The problems occurring during the pulling-in of the stirrup 30 according to the prior art are described in detail below and illustrated with the aid of FIG. 1.

For this purpose, FIG. 1 shows, in addition to the end position of the stirrup 30, four further positions, indicated by 1 to 4, in dashed lines, which the stirrup 30 assumes in a chronological sequence during the pulling-in, before finally arriving in the end position 5 (with an inclination angle $\alpha$ against the vertical). In addition, the direction of movement of the stirrup 30 is marked by a dashed arrow.

The positioning of a stirrup 30 in its end position 5 in the straight longitudinal recess 22 of an L-shaped sheet metal part 20 runs as follows:

First, the stirrup arch 34 of the stirrup is lowered through the upper longitudinal reinforcement Boo, Bo, and positioned directly in front of the opening of the straight longitudinal recess 22 (position 1) and then subjected to a pulling force $F_Z$, which has a tangential component $F_{\|}$ directed in the longitudinal direction of the straight longitudinal recess 22. In order to form such a tangential component, the stirrup 30, starting from the vertical, has to be inclined by an angle $\beta$ in the direction of the straight longitudinal recess 22 (positions 2, 3). The tangential component $F_{\|}=F_Z \cdot \sin \beta$ of the pulling force $F_Z$ pulls the stirrup arch 34 into the straight longitudinal recess 22 (movement from position 3 to position 4), whereby the normal component $F_{\perp}=F_Z \cdot \cos \beta$ of the pulling force $F_Z$ during the pulling-in process leads to undesired friction of the stirrup arch 34 on the upper side of the straight longitudinal recess 22. At small angles $\beta$, the desired tangential component $F_{\|}$ is small, while the undesired normal component $F_{\perp}$ is large, so that the operator must apply a large pulling force $F_Z$, which leads to his rapid fatigue. The formulas $F_{\|}=F_Z \cdot \sin \beta$ and $F_{\perp}=F_Z \cdot \cos \beta$ show that it is possible to increase $F_{\|}$ and reduce $F_{\perp}$, by increasing the inclination angle $\beta$ of the stirrup 30 during pulling-in. This is achieved by means of long stirrups 30, which can be pulled under an inclination angle $\beta \approx 25° \ldots 40°$ and occupy an inclination angle $\alpha=30° \ldots 45°$ against the vertical in their end position. The maximum permissible stirrup length $H_B$ for such stirrups is $H_B=h_B \cdot \sqrt{2}$ (for an inclination angle $\alpha=45°$), this is more than 40% above the minimum stirrup length $h_B$, combined with the corresponding additional material consumption.

When the stirrup arch 34 has reached its target position in the fastening region BF, the stirrup shoulders are laid down on two bars of the uppermost longitudinal reinforcement layer Boo. Here, the stirrup 30 reaches its end position (position 5) in which it takes the inclination angle $\alpha$ against the vertical.

(The relationship of $F_Z$, $F_{\|}$, $F_{\perp}$ and $\beta$ is shown schematically in FIG. 1 at position 3. In position 5, the inclination angle $\alpha$ of the stirrup in its end position is shown.)

FIG. 1 illustrates yet another disadvantage of the pulling-in, which in practice has proved to be the most serious one:

The stirrup legs of the stirrup 30 (i.e. the two stirrup sections which connect the two stirrup shoulders 32 to the stirrup arch 34) must be movable parallel to the bars of the uppermost reinforcement layer Boo over a very long horizontal clearance R. FIG. 1 shows that this clearance R must correspond to at least twice the width of the L-shaped sheet metal part 20 in order to ensure a comfortable and rapid pulling-in and thus an efficient and economical working process on the construction site.

In order to ensure this horizontal clearance R, no bars of the upper longitudinal reinforcement layer Bo running at right angles to the uppermost longitudinal reinforcement layer Boo can be located in its region. In FIG. 1, three bars of the upper longitudinal reinforcement layer Bo are shown, whereby the middle bar, represented by the dashed edge, is located in a position within the clearance R, which makes the insertion of the stirrup 30 impossible. This bar must be temporarily removed in order to be able to pull in the stirrup 30. Such a temporary removal of reinforcing bars is completely uneconomical and in the normal case not possible at all, since reinforcing mats are usually used in which the bars of the two longitudinal reinforcement layers Boo and Bo are welded to a grid, i.e. they are already fixed. It is extremely complex and under the time and cost pressure on the construction site impossible to position the L-shaped sheet metal parts 20 in such a manner that above each L-shaped sheet metal part 20 the very long horizontal clearance R shown in FIG. 1 to pull in the stirrup 30 is maintained. In addition, specified distances of the individual shear force reinforcing elements Q are to be maintained, so that in the case of in-situ concrete components the positions of the L-shaped sheet metal parts 20 must not be altered arbitrarily for adaptation to the upper longitudinal reinforcement.

In the case of semi-precast components, this is in any case impossible because the lower section of the L-shaped sheet metal parts 20 has already been cast with concrete. Thus, the L-shaped sheet metal parts 20 with stirrups 30 attached thereto cannot be used in conjunction with an upper longitudinal reinforcement Boo, Bo made of reinforcing mats, which excludes their efficient and economical use as shear force reinforcing elements.

In their installed position, the stirrups 30 should be directed in their end position in the direction of the tensile stresses occurring in the reinforced concrete/prestressed concrete component in order to absorb these tensile stresses. These tensile stresses are inclined towards the vertical, whereby their inclination angle, which differs for the individual shear force reinforcement elements Q, is generally not known exactly. A good compromise is therefore to use vertical or nearly vertical stirrups in practice. Since these stirrups produce the connection between the L-shaped sheet metal parts 20 and the upper longitudinal reinforcement Bo, Boo on the (almost) shortest path, their stirrup lengths $H_B$ may exceed the minimum stirrup length $h_B$ only slightly, preferably by not more than 6%. However, the installation of the stirrups 30 by means of pulling-in excludes the use of short stirrups 30, which occupy a vertical ($\alpha=0$) or at least nearly vertical ($\alpha<20°$) end position in the finished reinforced concrete/prestressed concrete component. Therefore, the desired embodiment of a shear force reinforcement consisting of L-shaped sheet metal parts 20 with (almost) vertical stirrups 30 is not even nearly realizable.

Thus, in the prior art, there is a conflict field between the use of long stirrups which reduce the force required by an operator during pulling-in and the use of short stirrups, which are strongly preferable for the formation of an effective shear force reinforcement.

OBJECT OF THE INVENTION

The object of the present invention is to eliminate the described disadvantages of the prior art.

Technical Solution

This object is achieved according to the invention by a flat component 21 according to claim 1, which has a feed region designed as a recess A, by a shear force reinforcing element Q according to claim 10, by a reinforced concrete/prestressed concrete component according to claim 13 and its use according to claim 15, and by the preferred embodiments described in the dependent claims. The flat, preferably rectangular, component 21 together with at least one stirrup 30 which can be connected to the flat component 21 forms the shear force reinforcing element Q. The terms used hereinafter regarding the orientation of the flat component 21 (e.g., lower section) refer to its alignment after installation in a reinforced concrete/prestressed concrete component. The flat component 21 is provided in its lower section with at least one holding means for fastening to the lower longitudinal reinforcement of this reinforced concrete/prestressed concrete component. These holding means comprise sufficiently large recesses 50 for fastening the flat component 21 to bars of the lowest longitudinal reinforcement layer Buu as well as an optional bend 40 immediately below the recess(es) 50. The optional bend 40 is designed at a right angle and serves as an additional stabilization of the flat component 21 in that it rests directly against the undersides of bars of the lowest reinforcing layer Buu positioned in the recesses 50. Owing to this additional stabilizing function, the design of the flat component 21 with a bend 40 is absolutely preferable.

The flat components 21 have a fastening region BF designed as a recess, which is located in the vicinity of the center line M of the flat component 21 and is suitable for positioning the arches 34 of one or two stirrups 30. According to the invention, the flat components also have a feed region, which is designed as a recess A, which is connected to the fastening region BF and allows the feeding of an arch 34 to the fastening region BF in a large angular range, wherein the feed angle measured from the horizontal is variable between at least 10° and 120°, as a result of which an easier feedability of the stirrups is achieved. The recess A can be narrowed in such a way that allows the feeding of an arch 34 in a preferred angular range or at a preferred feed angle $\zeta$.

The reinforced concrete/prestressed concrete component has an upper and a lower longitudinal reinforcement, wherein the upper longitudinal reinforcement can be implemented both in the form of individual reinforcing bars and, in a preferred embodiment, in the form of reinforcing mats, and is provided with a shear force reinforcement consisting of a suitable number of the shear force reinforcing elements Q according to the invention, which are made up of flat components 21 with stirrups 30 attached thereto which are led in their extension over the uppermost longitudinal reinforcement layer Boo and the lowermost longitudinal reinforcement layer Buu. Practical tests and simulations have shown that such a shear force reinforcement of preferably at least 20 shear force reinforcing elements Q ensures a required load bearing capacity of the reinforced concrete/prestressed concrete component.

Furthermore, the object of the invention is solved by the specification of a method in which the installation of a stirrup 30 in a flat component 21 takes place by pushing-in. In their end position, the stirrups 30 assume a small inclination angle $\alpha$, which lies in the range $\alpha<20°$, preferably $\alpha<10°$. In the ideal case, the stirrups 30 are oriented perpendicularly in the end position ($\alpha=0$). The small inclination angle $\alpha$ is ensured by the use of short stirrups 30, the stirrup length $H_B$ of which exceeds the minimum stirrup length $h_B$ by an amount ≤6%. Such stirrups 30 assume an inclination angle $\alpha<20$ degree in the end position. The stirrup lengths $H_B=1.02\cdot h_B$ and $H_B=h_B$ are particularly preferred.

DETAILED DESCRIPTION OF THE INVENTION

Part 1 of the Solution: Flat Component 21 According to the Invention, Shear Force Reinforcement Element Q and Reinforced Concrete/Prestressed Concrete Component Equipped Therewith A large number of tests with flat components having different shapes of longitudinal recesses showed that the object of the invention is optimally solved by a flat, preferably rectangular, component 21 and at least one stirrup 30 mountable to the flat component 21. The flat component 21 is provided in its lower section with at least one holding means for fastening to the lower longitudinal reinforcement of a reinforced concrete/prestressed concrete component. These holding means comprise sufficiently large recesses 50 for fastening the flat component 21 to bars of the lowest longitudinal reinforcing layer Buu, as well as an optional bend 40 immediately below the recess(es) 50. The recesses 50 can lie completely inside the flat component 21, so that a bar of the lowest reinforcing layer Buu can be passed through each of the recesses 50. In order to prevent the flat component 21 from rotating about such a bar, the flat component 21 preferably has two recesses 50 for the positioning of such bars, which secure the flat component 21. Instead of completely inside the flat component 21, the recesses 50 can also be designed to be open or semi-open to the side edges of the flat component 21. In this case, a bar of the lowest reinforcing layer Buu can be introduced from the sides into a recess 50 of the flat component 21. The optional bend 40 is designed at a right angle and offers the possibility of an additional stabilization of the flat component 21 by resting directly against the undersides of bars of the lowest reinforcement layer Buu positioned in the recesses 50. Advantageously, the bend 40 is provided with additional recesses (as can be seen in FIG. 2*c*, bottom), which permit the passage of fixing wires with which the bend 40 is drawn up to the bars of the lowest reinforcement layer Buu, so that the flat component 21 is fixed tilt-proof and non-displaceable (so-called wire-tying). Due to this additional stabilizing function, the design of the flat component 21 with a bend 40 is absolutely preferable.

The flat component 21 has a fastening region BF which is designed as a recess, which is located in the vicinity of the center line M of the flat component 21 and is suitable for positioning the arches of one or two stirrups 30. The fastening region BF is designed such that it has a defined distance from the upper longitudinal reinforcement after installation of the flat component 21 in a reinforced concrete/prestressed concrete component. The fastening region BF is therefore preferably designed as a horizontal slot. To enable a more stable fixing of the stirrups 30, it can also be slightly inclined or have an additional recess on its top side (in the direction of the upper edge of the flat component 21) for receiving the stirrup arches 34.

According to the invention, the flat component 21 furthermore has a feed region which is designed as a recess A and is connected to the fastening region BF, which allows the feeding of an arch 34 to the fastening region BF in a large angular range, whereby the feed angle $\zeta$, measured from the horizontal, is variable between at least 10° and 120°. A recess A, which allows this large angular range, extends over an area which is delimited by the upper section of a side edge and a part of the upper edge of the flat component 21 and is marked by a dashed line in FIG. 2*a*. FIG. 2*a* shows that the feeding of a stirrup arch 34 can be carried out extremely variably, e.g. at angles of 10°, 30°, 45°, 60°, 90° and 120° as indicated in this sequence by arrows a to f.

In a preferred embodiment of the invention, the recess A is narrowed in a manner that allows the feeding of an arch 34 only in a suitable angular range to be selected from the range $10°\leq\zeta\leq120°$. Suitable angle ranges are $10°\leq\zeta\leq110°$, preferably $80°\leq\zeta\leq110°$ (whereby the operator can see the feeding area from above and can position the stirrup more quickly and securely) and $10°\leq\zeta\leq80°$ (whereby a good guidability of the stirrup arch 34 is ensured at the lower edge of the funnel-shaped recess A), and, more preferably, $40° \leq \zeta \leq 50°$ (whereby an optimum compromise of the operator's effort and the guidability of the stirrup is achieved).

In a further preferred embodiment of the invention, the recess A is narrowed in a manner that allows the feeding of an arch 34 only at a selected feed angle, which is also to be selected from the range $10° \leq \zeta \leq 120°$. Preferred feed angles are $\zeta=30°$, $\zeta=45°$, $\zeta=60°$, a particularly preferred angle is $\zeta=45°$. In these cases, the feed region, formed by the recess A, narrows to a feed channel S in the form of an obliquely upwardly directed slot with an opening 29 to the exterior which is suitable for feeding an arch 34. A feed channel S like this together with the fastening region BF forms an angled longitudinal recess 23.

Due to the oblique course of the feed channel S, the distance between the opening 29 and the upper longitudinal reinforcement is less than the distance between the fastening region BF and the upper longitudinal reinforcement (after installation of the flat component 21 in a reinforced concrete/prestressed concrete component). This feature is a crucial prerequisite for the use of short stirrups 30. The feed channel S is preferably designed in a straight line, but it can also be arcuate, with the arc radius corresponding to the distance between the fastening region BF and the upper longitudinal reinforcement (as indicated in dashed line in FIG. 2*b*).

The vertical positioning of the fastening region BF and the height of the flat component 21 result from the following considerations: The distance of the fastening region BF from the lower, preferably bent side of the flat component 21 must be so great, that the fastening region BF remains freely accessible when the flat component 21 is installed in a prestressed concrete component which is constructed as a semi-precast part, which is already poured with concrete. Since the casting height in practice amounts 4 cm to 6 cm over the lower longitudinal reinforcement, the fastening region BF should be at least 7 cm from the lower side of the flat component 21. In order to ensure that the flat component 21 also has the necessary stability in the region of the angled longitudinal recess, at least one third of its surface should lie above the fastening region BF. On the other hand, the flat component 21, installed in a reinforced concrete/prestressed concrete component, must have a sufficient distance from its upper longitudinal reinforcement, even for reinforced concrete/prestressed concrete elements of small thickness (near or equal to a minimum thickness of 18 cm). A flat component 21 having a height between 11 cm and 12 cm and a fastening region BF, which is 7 cm to 8 cm from the lower side of the flat component 21, solves the object of the invention. The flat component 21 and the stirrups 30 must consist of a material of high tensile strength. Suitable materials which combine a high tensile strength with an easy workability are structural steel and reinforcing steel, whereby structural steel is preferred for the flat components 21, whereas reinforcing steel is preferred for the stirrups 30. If it is made of structural steel, the flat component 21 should have a thickness of at least 1 mm, preferred thicknesses are 3 mm and 5 mm. For the stirrups 30, ribbed reinforcing bar steel with a nominal diameter of 6 mm is preferably used. Other tensile-strength materials can also be used, whereby the dimensions may be adapted by a person skilled in the art.

FIG. 2*b* shows the schematic representation of a preferred embodiment of a flat component 21 according to the invention, which is equipped with an angled longitudinal recess 23. As it is preferably made of structural steel and has an optional, but absolutely preferable, bend 40, which gives it an L-shaped cross-section, it is designated as an L-shaped sheet metal part 21 in the following and in all the exemplary embodiments. In the fastening region BF, one or two stirrups 30 (not shown in FIG. 2*b*) can be installed.

On the lower edge of the feed channel S of the angled longitudinal recess 23 and on the side edge of the L-shaped sheet metal part 21, there are two recesses 25*a* and 26*a* which form a notched projection 27*a*, at which a clip plate part 24*a* can be snapped in by pushing it in the direction of the arrow shown in FIG. 2*b* for fixing and securing the stirrups 30. In order to ensure a secure snapping-in of the clip plate part 24*a*, the recess 25*a* is preferably of a rectangular design. The shape of the recess 26*a* is largely freely selectable. It is preferably designed as a triangle, which is large enough that the clip plate part 24*a* can be installed. Thus, the load-bearing capacity of the L-shaped sheet metal part 21 is not impaired by the recess 26*a*.

The feed angle $\zeta$ at which a stirrup arch 34 can be fed in, is determined in this configuration by the inclination angle $\gamma$ of the feed channel S against the fastening region BF ($\zeta=\gamma$). The inclination angle $\gamma$ is selectable from the same range as $\zeta$. The range $30° \leq \gamma \leq 60°$ in which also short stirrups 30 can be reliably fed in is preferred, whereby the angles $\gamma=30°$, $\gamma=45°$ and $\gamma=60°$ are particularly preferred, i.e. the angles which are also preferred for $\zeta$. The lengths $L_S$ of the feed channel S and $L_{BF}$ of the attachment region BF are variable relative to one another, whereby the equation $L_S \cdot \cos \gamma + L_{BF} = T$ is fulfilled. T is the depth of the longitudinal recess 23 (extending from the side edge of the L-shaped sheet metal part). Preferably, the depth T of the angled longitudinal recess 23 extends by one stirrup diameter beyond the center line M of the L-shaped sheet metal part 21 so that the fastening region BF lies precisely in the region of the center line M and the L-shaped sheet metal part 21 is thus evenly loaded. However, in order to increase the load-bearing capacity of the L-shaped sheet metal part 21, a smaller depth T can be selected as shown in FIG. 2*b*.

The length $L_{BF}$ of the fastening region BF is selected in such a manner and the positions of the recesses 25*a*, 26*a* for fastening the clip plate 24*a* are arranged in such a way that either one or two stirrup arches 34 can be inserted into the fastening region BF and secured by snapping-in a clip plate part 24*a*.

An essential prerequisite for the installation of the stirrups 30 is, that the opening 29 of the angled longitudinal recess 23 is higher than the fastening region BF, which is ensured by the feed channel S extending obliquely upwards from the fastening region BF to the opening 29. The height difference HD between the opening 29 and the fastening region BF is given here by the projection $L_S \cdot \sin \gamma$ of the feed channel S onto the side edge of the L-shaped sheet metal part 21. A height difference HD of 1 cm to 2 cm is sufficient in order to be able to install even short stirrups safely. In order to ensure a free movability of an arch 30 in the longitudinal recess 23, the height of the longitudinal recess 23 must be a little greater than the nominal diameter of the stirrup 30, i.e., the nominal diameter of the bar material used for producing the stirrups 30 (preferably reinforcing bar steel). The stirrup surface is preferably ribbed, which results in the outer diameter of the stirrups 30 being larger than their nominal diameter. The free movability of the arch 30 in the longitudinal recess 23 is ensured in any case if the height of the longitudinal recess 23 is one third larger than the nominal diameter of the stirrup 30. In the finished reinforced concrete/prestressed concrete element the ribbed stirrup surface forms a stable connection with the surrounding concrete and therefore increases the load-bearing capacity of the reinforced concrete/prestressed concrete component. The angled longitudinal recess 23 can be modified in various ways: The feed channel S can also be arcuate. It is important that, even in the case of an arcuate design of the feed channel, the above-mentioned height difference HD is ensured. The fastening region BF can be slightly inclined upwards in the direction of the center line M in order to assist in the fixing of the stirrups 30. A horizontally extending fastening region is preferred since it has a defined distance to the upper longitudinal reinforcement after installation of the L-shaped sheet metal part 21 in a reinforced concrete/prestressed concrete component. It is possible to provide the upper side of the fastening region BF with a recess which supports the fixing of the arches 34. The recess should have a small height of 1 mm so that the distance from the upper longitudinal reinforcement is only slightly increased. If a slightly inclined fastening region BF is selected, it should also rise along its length only by a small amount of about 1 mm in the direction of the center line M.

In order to realize the object of the invention, a small inclination angle $\alpha$ of the stirrup 30 in its end position ($\alpha<20°$, preferably $\alpha<10°$, ideally $\alpha=0$), the following considerations are useful for selecting the stirrup lengths $H_B$:

As shown in FIG. 3, the minimum stirrup length $h_B$ is given by the distance from the upper edge of the fastening region BF of the angled longitudinal recess 23 to the upper edge of the uppermost longitudinal reinforcement layer Boo plus twice the nominal diameter of the stirrup 30. The inclination angle $\alpha$ of the stirrup in its end position is determined by the ratio of the stirrup length $H_B$ to the minimum stirrup length $h_B$ according to $\cos\alpha=h_B/H_B$. In the case of an inclined stirrup, the stirrup shoulders show a lateral offset V relative to the stirrup arch (see FIG. 3). Examples of quantitative data are shown in the following table:

| $H_B$ | cos α | α | V (at $h_B$ = 12 cm) | V (at $h_B$ = 30 cm) |
|---|---|---|---|---|
| $1.41 \cdot h_B$ | 0.71 | 45° | 12 cm | 30 cm |
| $1.15 \cdot h_B$ | 0.87 | 30° | 6.9 cm | 17.3 cm |
| $1.07 \cdot h_B$ | 0.93 | 20.8° | 4.6 cm | 11.4 cm |
| $1.06 \cdot h_B$ | 0.94 | 19.4° | 4.2 cm | 10.6 cm |
| $1.05 \cdot h_B$ | 0.95 | 17.8° | 3.9 cm | 9.6 cm |
| $1.04 \cdot h_B$ | 0.96 | 15.9° | 3.4 cm | 8.6 cm |
| $1.03 \cdot h_B$ | 0.97 | 13.9° | 3.0 cm | 7.4 cm |
| $1.02 \cdot h_B$ | 0.98 | 11.4° | 2.4 cm | 6.0 cm |
| $1.01 \cdot h_B$ | 0.99 | 8.1° | 1.7 cm | 4.3 cm |
| $1.00 \cdot h_B$ | 1 | 0° | 0 cm | 0 cm |

According to the above definition, characterizing stirrups 30 with an inclination angle $\alpha<20°$ in the end position as short stirrups, in the above table the stirrups 30 with stirrup length $1.00 \cdot h_B \leq H_B \leq 1.06 \cdot h_B$ are classified as short stirrups, and the stirrups with stirrup lengths $H_B=1.07 \cdot h_B$, $1.15 \cdot h_B$, $1.41 \cdot h_B$ are classified as long stirrups.

In order to be also able to install the stirrups 30 reliably when using reinforcing mats as the upper longitudinal reinforcement of a reinforced concrete/prestressed concrete component, the lateral offset V must be less than half the bar spacing in the reinforcing mat. A standard bar spacing is 15 cm. The table shows that stirrups with a length of $H_B=1.06 \cdot h_B$ can be safely installed in the case of a minimum stirrup length $h_B$=12 cm (suitable for a concrete/prestressed concrete component of approximately 24 cm thickness). In the case of a minimum stirrup length $h_B$=30 cm (suitable for a reinforced concrete/prestressed concrete component of approximately 42 cm thickness), the lateral offset V for stirrups of the lengths $H_B=1.06 \cdot h_B$ would already be too great. Stirrups of a stirrup length ($H_B \leq 1.03 \cdot h_B$) are required.

Theoretically, it is possible to choose stirrups 30 of the minimum stirrup length $h_B$, which are vertically directed in their end position ($\alpha=0$). However, in practice manufacturing tolerances must always be considered, which may lead to deviations of the stirrup lengths. It is therefore not practical to use stirrups 30 with the minimum stirrup length $h_B$, as a fraction of these stirrups could be too short and therefore could be not installable. Stirrups 30 of the stirrup length $H_B=1.02 \cdot h_B$ represent a suitable compromise. They have a small inclination angle in the end position ($\alpha=11.4°$, if the stirrup lengths are exactly kept) and are not at risk of being unable to be installed due to manufacturing tolerances. Within the scope of this invention, however, stirrups 30 with shorter stirrup lengths ($1.01 \cdot h_B$) including the minimum stirrup length $h_B$ are also claimed, since such stirrups will become practically relevant in the future due to decreasing manufacturing tolerances. The saving of bar material is to be mentioned as an advantageous secondary effect of the use of short stirrups 30.

An advantage of the shear force reinforcing element Q is that the adaptation to reinforced concrete/prestressed concrete components of different thicknesses is realized by the variation of the stirrup length $H_B$. Thus identical L-shaped sheet metal parts 21 can be used for reinforced concrete/prestressed concrete components of different thicknesses.

Example 1 (Concerning the L-Shaped Sheet Metal Part 21)

FIG. 2*c* shows in the front view (top left), side view (top right) and top view (bottom) a specific embodiment of the L-shaped sheet metal part 21 according to the invention, as it is provided for practical use. The reference signs, directly transferable from FIG. 2*b*, have been omitted in order to be able to clearly represent all dimensions and tolerances (always in millimeters). Only a snapped clip plate part 24*a* is shown with its reference sign, in order to illustrate its function as a position securement. The L-shaped sheet metal part 21 is made of structural steel with a thickness of 3 mm or 5 mm and is produced inexpensively as a free-falling punched part. It has a height of 116 mm or 118 mm (resulting from the different thicknesses) and a width of 69 mm. The selected width results from the application conditions of the L-shaped sheet metal parts in practice: Several L-shaped sheet metal parts are threaded onto bars of the lowest longitudinal reinforcement layer Buu (by means of carrying the bars through the recesses 50) to form a line element, which is inserted as a supplementary reinforcement between the bars of an already present lowermost reinforcing layer Buu into the basic body (reinforcement arrangement before casting with concrete) of a reinforced concrete/prestressed concrete component. The bars of the already present longitudinal reinforcement layer Buu usually have a spacing of 10 cm or 15 cm. A line element with L-shaped sheet metal parts 21 of the selected width of 69 mm can be conveniently placed in this spacing in both cases, whereby the resulting overall arrangement of the bars of the lowest longitudinal reinforcing layer Buu gets approximately equidistant bar gaps. Of course, the width of the L-shaped sheet metal part 21 can be optimized by taking the specific application conditions into account.

The angled longitudinal recess 23 has a depth T=(30±1) mm. The feed channel S of the angled longitudinal recess 23 is inclined by $\gamma=45°$ with respect to the horizontally extending fastening region BF, which has a length of (16±1) mm, so that the feed angle is $\zeta=45°$. A height difference HD of 14 mm is realized between the opening 29 and the fastening region BF of the angled longitudinal recess 23 of the L-shaped component 21. Via the feed channel S, the stirrup arches 34 (not shown) of one or two stirrups 30 can be pushed into the fastening region BF. The angled longitudinal recess 23 has a height of 8 mm, so that the stirrups 30 made of reinforcing bar steel with a nominal diameter of 6 mm are freely movable in the angled longitudinal recess 23.

Part 2 of the Solution: Pushing the Stirrups into the Angled Longitudinal Recesses 23 of the L-Shaped Sheet Metal Parts 21 According to the Invention Initial situation before pushing-in:

A basic body for a reinforced concrete/prestressed concrete component is provided, which is equipped with the required number of L-shaped sheet metal parts 21 with an angled longitudinal recess 23 according to the invention. The L-shaped sheet metal parts 21 are connected in the manner described above with the lower longitudinal reinforcement Buu, Bu. The reinforced concrete/prestressed concrete component can be designed as a semi-precast part or as an in-situ concrete part. In case of a semi-precast part, the lower part of the basic body is already cast with concrete in the precast factory. The casting height is selected in a way so that the angled longitudinal recesses 23 for installing the stirrups 30 and the recesses 25*a*, 26*a* for the installation of the clip plate parts 24*a* still remain free. This is ensured in any case by a casting height of 4 cm to 6 cm. In case of an in-situ concrete component, the concrete is completely cast on the building site. The upper longitudinal reinforcement, consisting of the longitudinal reinforcement layers Boo and Bo, is already laid in both cases. The upper longitudinal reinforcement can be designed as a reinforcing mat in which the two longitudinal reinforcement layers Bo and Boo are welded together and thus the horizontal clearance R, available for installing the stirrups, can no longer be changed. This design of the upper reinforcement as a reinforcing mat is absolutely preferred because it is much faster, more precise and more cost-effective to install than single reinforcing bars.

Procedure of the Pushing-in Process:

For pushing-in, the stirrup legs of a prefabricated stirrup 30 of the length $H_B$, which is selected as described above, are lowered by an operator through the upper reinforcement so that the stirrup arch 34 connecting the two stirrup legs is positioned directly in front of the opening 29 of the angled longitudinal recess 23. During lowering, the stirrup 30 is preferably held under a slight inclination angle β against the vertical (β<10°) or even vertically. However, it is possible, as explained in more detail in example 3, to incline the stirrup 30 much more strongly if necessary, particularly to avoid a collision with a bar of the upper longitudinal reinforcement layer Bo. Due to the obliquely upwardly directed feed channel S of the angled longitudinal recess 23, its opening 29 is displaced upwards, so that the stirrup arch 34 of a more inclined stirrup 30 can also be positioned in front of the opening 29. Thus, during pushing-in the inclination angle β of the stirrup 30 can be greater than the inclination angle α, which the stirrup 30 takes in the end position.

As soon as the stirrup arch 34 is positioned exactly in front of the opening of the angled longitudinal recess 23, a pushing force $F_D$ is exerted by the operator on the stirrup 30, which moves the stirrup arch 34 through the opening 29 of the angled longitudinal recess 23 into its feed channel S and then through the feed channel S into the fastening region BF of the angled longitudinal recess 23. Surprisingly, it was found that a small pushing force $F_D$ is already sufficient for this purpose, which is much smaller than the pulling force $F_Z$ required for pulling-in according to the state of the art. As a cause of this advantageous effect, it has been found that there is no hindering friction of the stirrup arch 34 on the upper edge of the longitudinal recess 23 during pressing-in. The stirrup arch 34 slides almost frictionless into the fastening region BF. The stirrup shoulders 32 of the stirrup 30 are then laid down on two bars of the uppermost longitudinal reinforcement Boo, whereby the stirrup 30 takes in this end position an inclination angle α which is due to the stirrup length $H_B$.

During the entire pushing-in process, the upper part of the stirrup 30 formed by the stirrup shoulders 32 has to be moved only in a very short horizontal clearance R. A clearance R, which corresponds to the depth T of the angled longitudinal recess 23, always suffices for convenient operation. Even a smaller clearance R with a length few millimeters greater than the outer diameter of the stirrup 30, which just allows the stirrup 30 to be passed between two very close-lying bars of the upper longitudinal reinforcement layer Bo and to be inclined up to 45°, is already sufficient for pushing-in. For example, if the outer diameter of the stirrup is 8 mm (a typical value in practice), a clearance R of length $8\ \text{mm}\cdot\sqrt{2}\approx 12$ mm is sufficient to pass the stirrup 30 inclined by 45° through the upper longitudinal reinforcement. In practice the available clearance R is always significantly larger, since the spacing between two reinforcing bars in commercially available reinforcing mats is 10 cm or 15 cm as standard. Therefore, it is always possible without difficulty to push the stirrup arches 34 into the angled longitudinal recesses 23 of the L-shaped sheet metal part 21. The selection of a short stirrup length $H_B$ ensures that the stirrup 30, after depositing its shoulders on two bars of the uppermost longitudinal reinforcement layer Boo, takes a small inclination angle α, so that the stirrup shoulders 32 have a small lateral offset V, preferably V<5 cm. Therefore, a clearance R≤5 cm is sufficient to bring the stirrup 30 into its end position. Starting from the vertical, this clearance R is always present at least in one of the two possible directions for depositing the stirrup shoulders 32. When the installation of the stirrups 30 has been completed for all L-shaped sheet metal parts 21, the reinforced concrete/prestressed concrete component is finished by casting with concrete.

For the individual L-shaped sheet metal parts 21 several substantially different situations are possible during the pushing-in of the stirrups 30 due to the respective position of the bars of the upper longitudinal reinforcement Bo. They are described in the following examples.

Example 2: Above the Angled Longitudinal Recess 23 of the L-Shaped Sheet Metal Part 21 there is No Bar of the Upper Reinforcement Layer Bo In this situation shown in FIG. 3, the required horizontal clearance R is optimally positioned, i.e. directly available. A simple statistical estimate shows, that this advantageous situation is present for more than 70% of the L-shaped sheet metal parts 21. The L-shaped sheet metal part 21 shown in FIG. 3 has the dimensions indicated in FIG. 2*c*. A stirrup 30 of the stirrup length $H_B=1.03\cdot h_B$ is used, which is 3% greater than the minimum stirrup length $h_B$, which is in this case 16 cm. Therefore, the stirrup length $H_B$ is 16.5 cm. During the pushing-in, the stirrup arch 34 is guided via the positions 1 and 2 into the fastening region BF of the angled longitudinal recess 23 by means of the pushing force $F_D$ acting on the stirrup 30. Thereafter, the stirrup is inclined to the left into its end position 3, assuming an inclination angle $\alpha \approx 14°$. It is visible that a clearance R of about 3 cm is sufficient to push in the stirrup 30 and to place it with its stirrup shoulders 32 on two bars of the uppermost longitudinal reinforcement layer Boo. In the arrangement in FIG. 3, it is also possible to place the stirrup 30 to the right, since the necessary free space is also available. Likewise, two stirrups 30 can be pushed in, one being placed to the right, the other to the left.

Figure 4:
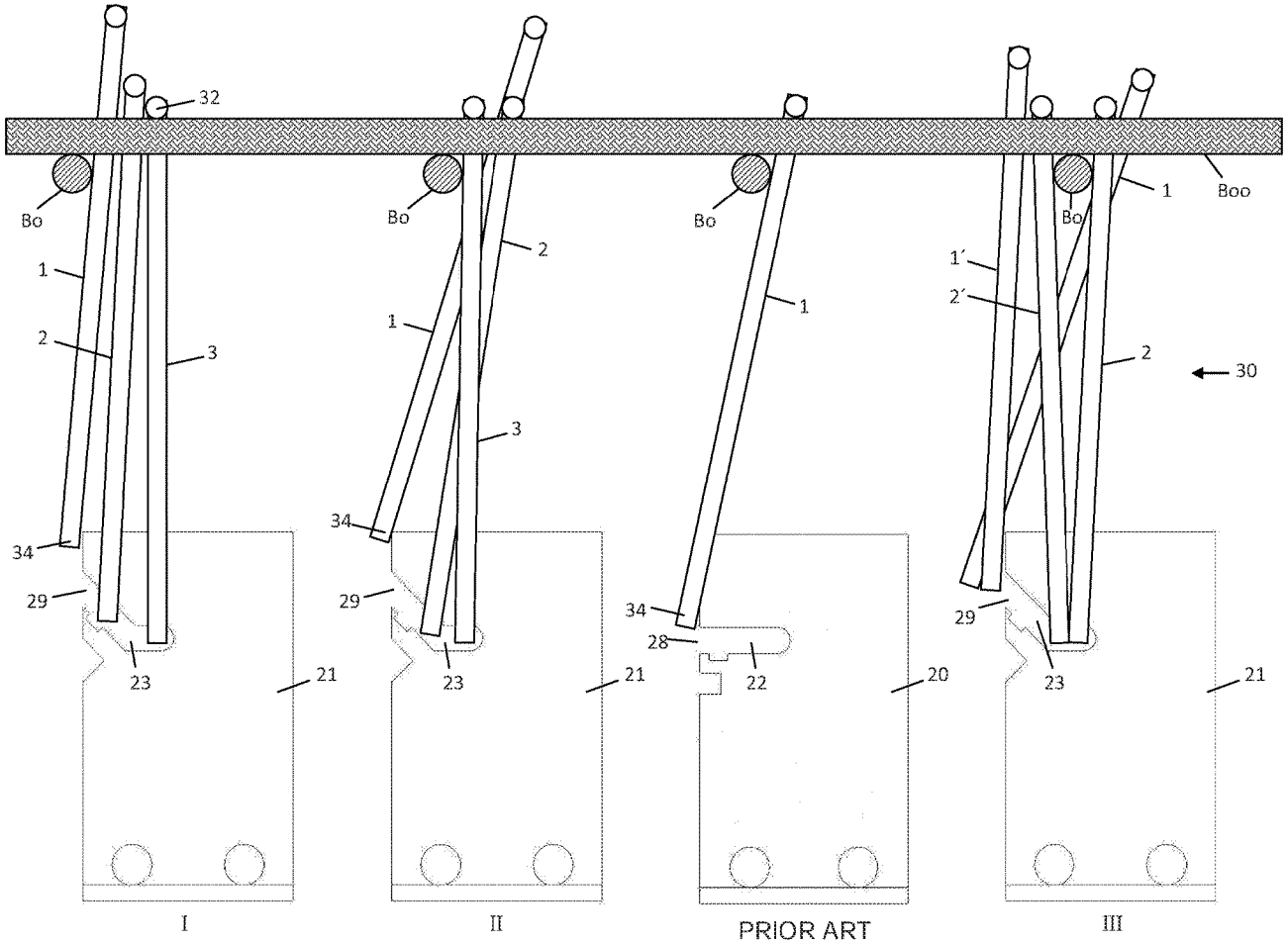

Example 3: Above the Angled Longitudinal Recess 23 of the L-Shaped Sheet Metal Part 21 there is a Bar of the Upper Reinforcement Layer Bo A bar of the upper reinforcement layer Bo, which is located above the angled longitudinal recess 23 of the L-shaped sheet metal part 21, hinders the movement of the stirrup legs 32 parallel to the bars of the uppermost reinforcement layer Boo. Three corresponding situations (I, II, III) are shown in FIG. 4. In total, they are present for less than 30% of the L-shaped sheet metal parts 21. In this case, there is no optimally positioned horizontal clearance of length T above the angled longitudinal recess 23 of the L-shaped sheet metal part 21. However, horizontal clearances with a length significantly greater than T are present on both sides of the bar of the upper reinforcement layer Bo acting as an obstacle. These clearances are in the same way suitable as an optionally positioned horizontal free space for pushing-in the stirrups 30.

Stirrups 30 of the minimum stirrup length $h_B$ are used which are vertical or nearly vertical in the end position. The pushing-in of the stirrups 30 is running as illustrated in FIG. 4. It is shown how to proceed at three different positions of the bar of the upper reinforcing layer Bo acting as an obstacle.

In situation I, a bar of the upper reinforcing layer Bo is located vertically above the opening 29 of the angled longitudinal recess 23. FIG. 4 illustrates that the stirrup 30 of minimum stirrup length $h_B$, by slightly tilting, passes easily the obstructive bar (stirrup position 1), its stirrup arch 34 can be pushed into the opening 29 of the angled longitudinal recess 23 and can be guided through the feed channel S (stirrup position 2) and the stirrup 30 can be brought into a vertical end position (stirrup position 3). In this end position, the stirrup arch 34 is located in the fastening region BF of the angled longitudinal recess 23, while the stirrup shoulders 32 of the stirrup 30 rest on two bars of the uppermost longitudinal reinforcement layer Boo. In this example, the stirrup 30 has an inclination angle $\alpha=0°$ in the end position, while at the beginning of the pressing-in operation (stirrup position 1) it had an inclination angle $\beta=5°$.

In situation II, a bar of the upper reinforcement layer Bo is located vertically above the transition from the feed channel S into the fastening region BF of the angled longitudinal recess 23. FIG. 4 shows that a stirrup 30 of minimum stirrup length $h_B$ is also easily passed near the obstructive bar in this situation (stirrup position 1). For this purpose (compared to situation I), it must only be brought into a slightly larger inclination angle $\beta$ (here $\beta=17°$). Its stirrup arch 34 is then pushed into the opening of the angled longitudinal recess 23 and is guided through the feed channel S (stirrup position 2) into the fastening region BF of the angled longitudinal recess. Due to the bar of the upper reinforcing layer Bo positioned above the transition from the feed channel S into the fastening region BF, the stirrup 30 cannot be brought here into an exactly vertical end position. However, it is possible to bring it into a nearly vertical end position. FIG. 4 shows that in this example already an inclination angle $\alpha=1°$ is sufficient to pass the stirrup 30 by the obstructive bar of the upper reinforcement layer Bo. In order to bring the stirrup 30 into this end position, the operator only has to clamp slightly the stirrup shoulders 32.

In situation II, the clear advantages of the inventive L-shaped sheet metal part 21 with an angled longitudinal recess 23 over the prior art are shown. For clarification, in FIG. 4 the same situation for an L-shaped sheet metal part 20 according to the prior art is shown. In situation II, a stirrup 30 of minimal stirrup length $h_B$ can be installed without difficulty in an L-sheet metal 21 according to the invention, since because of the obliquely upwardly directed feed channel S the opening 29 of the angled longitudinal recess 23 is reached by the stirrup arch 34 of the stirrup of minimum stirrup length $h_B$, even if it is brought into a large inclination angle (here $\beta=17°$).

On the other hand, as shown in FIG. 4, it is not possible to install a stirrup 30 of minimum stirrup length $h_B$ in an L-shaped sheet metal part 20 according to the prior art, since such a stirrup 30 (typical nominal diameter of 6 mm) with its stirrup arch 34 pushes against the side edge of the L-shaped sheet metal part 20 and therefore it does not reach the opening 28 of the horizontally extending longitudinal recess 22 and cannot be inserted into it. It is absolutely necessary to use a longer stirrup 30 which has an undesirable, substantially greater inclination in its end position and cannot be installed when the upper longitudinal reinforcement Bo, Boo is constructed with reinforcement mats.

In situation III, a bar of the upper reinforcement layer Bo is located exactly vertically above the fastening region BF of the angled longitudinal recess 23. FIG. 4 shows that it is also possible here to push the stirrup arch 34 of a stirrup 30 of minimum stirrup length $h_B$ into the opening 29 of the angled longitudinal recess 23 by inclining it even more than in situation II (here $\beta=19°$ in stirrup position 1), and then bringing the stirrup 30 into its end position (stirrup position 2). Due to the obstructive bar of the upper reinforcing layer Bo, the stirrup 30 cannot be brought into an exactly vertical end position, but takes an inclination angle $\alpha=2.5°$ in the end position. Because of $1/\cos 2.5° \approx 1.001$, such a stirrup 30 has to have a 0.1% larger stirrup length compared to the minimum stirrup length $h_B$. As in situation II, a stirrup 30 of minimal stirrup length $h_B$ can also be used here, since the slightly larger stirrup length can be realized by putting the shoulders of the stirrup 30 under tension by the operator. In situation III, it is also possible to install a second stirrup 30 of minimal stirrup length $h_B$, which is, starting from the stirrup position 1', brought into its end position 2' in which it also has an inclination angle of $\alpha=2.5°$ (but inclined in the opposite direction). In this example, the two stirrups 30 form an opening angle $2\alpha=5°$ in their end positions 2 and 2'.

Thus, the objects of the invention are fully solved:

A shear force reinforcement made of L-shaped sheet metal parts 21 with vertical or nearly vertical stirrups 30 of minimum stirrup length $h_B$ is provided for a reinforced concrete/prestressed concrete component. The L-shaped sheet metal parts 21 with an angled longitudinal recess 23 ensure a rapid and effort-saving installation of the stirrups 30 by pushing the stirrup arches 34 into the angled longitudinal recess 23, whereby due to the small clearance R required for pushing-in a manual movement of reinforcing bars is not required. Therefore, the upper longitudinal reinforcement can be realized by means of reinforcing mats, which can be laid quickly and cost-effectively in comparison to individual reinforcing bars.

The reinforced concrete/prestressed concrete component with the shear force reinforcement according to the invention, made from L-shaped sheet metal parts 21 with vertical or nearly vertical stirrups 30 is provided particularly for use in the area of slab columns of flat slabs. It increases the punching shear resistance in the area of such slab columns.

The quantitative data in this patent application, particularly regarding the dimensions of the L-shaped sheet metal part 21, are to be regarded as exemplary and not restrictive. The quantitative adaptation to L-shaped sheet metal parts with changed dimensions is possible without any problems for a person skilled in the art. Such adaptations also belong to the claimed scope of protection of the invention.

FIGURE CAPTIONS

FIG. 1—Schematic representation of an L-shaped sheet metal part 20 according to the prior art in the installed state and the pulling-in of a stirrup 30 into the straight longitudinal recess 22 of an L-shaped sheet metal part 20.

FIG. 2*a*-Schematic representation of a flat component 21 with a recess A.

FIG. 2*b*-Schematic representation of preferred embodiment of a flat component 21, designed as an L-shaped sheet metal part with an angled longitudinal recess 23, in the front view.

FIG. 2*c*-Specific embodiment of an L-shaped sheet metal part 21 in the front, side and top view.

FIG. 3—Schematic representation of the pushing-in of a stirrup 30 into an angled longitudinal recess 23 of an L-shaped sheet metal part 21, in case there is no obstruction by a bar of the upper reinforcing layer Bo.

FIG. 4—Schematic representation of the pushing-in of a stirrup 30 into an angled longitudinal recess 23 of an L-shaped sheet metal part 21, in case there is an obstruction by a bar of the upper reinforcing layer Bo (for three different positions I, II, III of this bar, for position II as well comparison with the prior art).

Note: Curvatures of the stirrup arch 34 are not shown in FIG. 4 due to a technical simplification of the drawing. In FIGS. 2*b*-4 the recess 25*a* is shown in an unsuitably wide manner. It has to be reduced to about half the width by displacing its edge adjacent the lateral edge of the flat component 21 into the interior of the flat component 21.

REFERENCE KEY

1-5—temporally successive positions of a stirrup during pulling-in and pushing-in, resp.
20—L-shaped sheet metal part according to the prior art
21—flat component with angled longitudinal recess according to the invention, preferably designed as an L-shaped sheet metal part
22—straight longitudinal recess, designed as a horizontal slot
23—angled longitudinal recess, with fastening region BF and feed channel S
BF—fastening region
Z—feed region of a straight longitudinal recess 22
A—feed region designed as a recess
S—feed channel
clip plate part for notched projection 27
24*a*-clip plate part for notched projection 27*a*
25, 26—recesses for snapping-in a clip plate part (at an L-sheet according to the prior art)
25*a*, 26*a*-recesses for snapping-in a clip plate part (at an L-shaped sheet metal part according to the invention)
27—notched projection of an L-shaped sheet metal part 20 according to the prior art
27*a*—notched projection of an L-shaped sheet metal part 21 according to the invention
28—opening of the straight longitudinal recess 22 of an L-shaped sheet metal part 20
29—opening of the angled longitudinal recess 23
30·stirrup
32—stirrup shoulder
34—stirrup arch
40—bend
50—recesses just above the bend 40
Boo—uppermost reinforcement layer
Bo—upper reinforcement layer (immediately below Boo)
Buu—lowermost reinforcement layer
Bu—lower reinforcement layer (immediately above Buu)
M—center line of the flat component 21
Q—shear force reinforcing element consisting of an L-shaped sheet metal part 20 or 21 and a stirrup (or two stirrups) 30
R—required clearance for pulling-in or pushing-in a stirrup into a longitudinal recess 22 and 23, respectively
a-f—feeding a stirrup arch 34 under selected feed angles

FORMULA SYMBOLS $H_B$— length of stirrup
$h_B$—minimum stirrup length
HD—height difference between the opening 29 of the feed channel S and the fastening region BF
$L_{BF}$—length of the fastening region BF of the longitudinal recess 23
$L_S$—length of the feed channel S of the longitudinal recess 23
T—depth of the longitudinal recess 22 or 23
α—inclination angle of a stirrup 30 against the vertical axis (stirrup in end position)
β—inclination angle of a stirrup 30 against the vertical axis (while pulling and pushing, respectively)
γ—inclination angle of the feed channel S against the fastening region BF
ζ—feed angle, at which a recess A allows the feeding of a stirrup arch 33 to the fastening region BF
$F_Z$— pulling force when pulling on stirrups 30
$F_{\parallel}$— tangential component of the pulling force $F_Z$
$F_{\perp}$— normal component of the pulling force $F_Z$
$F_D$— pushing force while pushing the stirrup 30
V—lateral offset between stirrup shoulder 32 and stirrup arch 34

The invention claimed is:

1. A flat component of metal configured to provide a shear force reinforcing element (Q) and suitable for mounting a stirrup (30) thereto, comprising a lower section, configured for connection with a lower longitudinal reinforcement of a reinforced or prestressed concrete component, wherein the flat component has an angled longitudinal recess (23) ending in a fastening region (BF) and having a feed channel (S) connected thereto and opening to a vertical side edge or an upper horizontal edge of the flat component, wherein the feed channel has a feed angle ζ of between 10° to 120° to the horizontal and the fastening region (BF) is either horizontal or slightly inclined upwards as it extends away from the feed channel and toward a vertical centerline (M) of the flat component, and wherein the feed channel (S) is straight or arcuate and terminates in an opening (29) capable of feeding a stirrup arch (34), and further including a first recess (25*a*) on a lower edge of the feed channel (S) adjacent the opening (29) and a second (26*a*) recess on an outer edge of the flat component adjacent the opening (29), the two recesses opening generally in opposite directions so as to enable mounting a clip plate part (24*a*) for securing the stirrup (30) in the fastening region (BF).

2. The flat component according to claim 1, wherein the feed angle ζ comprises a range of 10° to 110°.

3. The flat component according to claim 1, wherein the feed angle ζ comprises a range of 10° to 80°.

4. The flat component according to claim 1, wherein the feed angle ζ comprises a range of 80° to 110°.

5. The flat component according to claim 1, wherein the feed angle ζ comprises a range of 40° to 50°.

6. The flat component according to claim 1, wherein the feed channel (S) and the fastening region (BF) both have a height of about 8 mm, so that a stirrup (30) having a nominal diameter of 6 mm is freely movable in the angled longitudinal recess (23).

7. The flat component according to claim 1, wherein the fastening region (BF) has an upper recess with a height of 1 mm or a slightly inclination which rises by about 1 mm as it extends in the direction of the center line (M) which supports the fixing of the arches (34).

8. The flat component according to claim 1, wherein the angled longitudinal recess (23) has a depth T=(30±1) mm and the feed channel (S) has a feed angle ζ=45° and a length of (16±1) mm.

9. The flat component according to claim 1, wherein the lower section has a right-angled bend (40).

10. The flat component according to claim 1, wherein the flat component is made of structural steel.

11. A shear force reinforcing element (Q) for a reinforced or prestressed concrete component, comprising:

a flat component of metal configured to provide a shear force reinforcing element (Q) and suitable for mounting a stirrup (30) thereto, comprising a lower section, configured for connection with a lower longitudinal reinforcement of a reinforced or prestressed concrete component, wherein the flat component has an angled longitudinal recess (23) ending in a fastening region (BF) and having a feed channel (S) connected thereto and opening to a vertical side edge or an upper horizontal edge of the flat component, wherein the feed channel has a feed angle ζ of between 10° to 120° to the horizontal and the fastening region (BF) is either horizontal or slightly inclined upwards as it extends away from the feed channel and toward a vertical centerline (M) of the flat component; and at least one stirrup (30) fastened to the flat component.

12. A shear force reinforcement element (Q) according to claim 11, wherein a stirrup length $H_B$ of the at least one stirrup (30), with respect to a minimum stirrup length $h_B$ equal to the distance from an upper edge of the fastening region BF recess to the upper edge of an uppermost longitudinal reinforcement layer to which the shear force reinforcing element (Q) mounts plus twice a nominal diameter of the stirrup (30), satisfies the condition $h_B<H_B\leq 1.06\cdot h_B$.

13. A shear force reinforcement element (Q) according to claim 12, wherein the stirrup length $H_B$ is selected from the group consisting of: $H_B=1.06\cdot h_B$, $H_B=1.05\cdot h_B$, $H_B=1.04\cdot h_B$, $H_B=1.03\cdot h_B$, $H_B=1.02\cdot h_B$ and $H_B=1.01\cdot h_B$.

14. A shear force reinforcing element (Q) according to claim 12, wherein the stirrups are made of reinforcing steel.

15. A shear force reinforcing element (Q) according to claim 12, wherein a stirrup length $H_B$ of the at least one stirrup (30) is equal to the minimum stirrup length $h_B$.

16. The flat component according to claim 11, wherein the lower section has a right-angled bend (40).

17. A reinforced or prestressed concrete component with an upper and a lower longitudinal reinforcement, comprising:

at least one shear force reinforcing element (Q) with a flat component of metal configured to provide a shear force reinforcing element (Q) and suitable for mounting a stirrup (30) thereto, comprising a lower section, configured for connection with a lower longitudinal reinforcement of a reinforced or prestressed concrete component, wherein the flat component has an angled longitudinal recess (23) ending in a fastening region (BF) and having a feed channel (S) connected thereto and opening to a vertical side edge or an upper horizontal edge of the flat component, wherein the feed channel has a feed angle ζ of between 10° to 120° to the horizontal and the fastening region (BF) is either horizontal or slightly inclined upwards as it extends away from the feed channel and toward a vertical centerline (M) of the flat component; and and at least one stirrup (30) connected to the flat component, whereby the at least one stirrup (30) of the at least one shear force reinforcing element (Q) has a connection to the upper longitudinal reinforcement of the reinforced or prestressed concrete component and the flat component has a connection to the lower longitudinal reinforcement of the reinforced or prestressed concrete component.

18. A reinforced or prestressed concrete component according to claim 17, wherein the upper longitudinal reinforcement is a reinforcing mat.

19. The flat component according to claim 17, wherein the lower section has a right-angled bend (40).

* * * * *